US005176262A

United States Patent [19]

Zouéki

[11] Patent Number: 5,176,262

[45] Date of Patent: Jan. 5, 1993

[54] DISPLAY APPARATUS

[76] Inventor: Georges Zouéki, 4812 Avenue Verdun, Verdun, Quebec, Canada, H4G 1N1

[21] Appl. No.: 828,171

[22] Filed: Jan. 30, 1992

[51] Int. Cl.[5] ..... A47F 7/00

[52] U.S. Cl. ..... 211/13; 248/902

[58] Field of Search ..... 211/13; 248/902, 229, 248/316.6, 316.4

[56] References Cited

U.S. PATENT DOCUMENTS

| | | | |
|---|---|---|---|
| 1,176,203 | 3/1916 | Comer | 248/229 |
| 1,631,355 | 6/1927 | Baldwin | 248/229 X |
| 1,780,308 | 11/1930 | Morris | 211/13 X |
| 2,711,872 | 6/1955 | Lampke | 248/229 X |
| 2,948,500 | 8/1960 | Kuhn | 248/902 X |
| 4,558,788 | 12/1985 | Grothaus | 211/13 |
| 4,890,745 | 1/1990 | Holden | 211/13 |

FOREIGN PATENT DOCUMENTS

| | | | |
|---|---|---|---|
| 967301 | 10/1950 | France | 248/229 |

*Primary Examiner*—Alvin C. Chin-Shue
*Assistant Examiner*—Sarah A. Lechok
*Attorney, Agent, or Firm*—Robic

[57] ABSTRACT

A display apparatus for displaying products such as eyeglasses or jewels, comprising a heavy base, a main stem having one end pivotally fixed to the base and another free end, and a tip element fixed to the free end of the main stem. The tip element includes another pivotable stem and a vise to attach the product to be displayed. Screws are used to apply friction to the surfaces of the stems to keep them in any desired orientation while allowing the stems to be turned without a tool. A brass tip helps reducing the wear on the stem surfaces in contact with the screws. The display apparatus may further comprise a sliding element including another pivotable stem and another vise to attach another product. The display apparatus is particularly well adapted for displaying eyeglasses in an optical shop window.

19 Claims, 3 Drawing Sheets

DISPLAY APPARATUS

FIELD OF THE INVENTION

This invention relates to an apparatus for displaying products such as eyeglasses or jewels. More precisely, the present invention is directed towards a holding device comprising a vise that may hold a product in any desired orientation in order to display it in a very attractive manner.

DESCRIPTION OF THE PRIOR ART

There exist many types of holders for displaying products such as, for example, eyeglasses. Reference to eyeglasses holders is suitable here for comparison purposes, because the present invention is well adapted to hold an eyeglass.

The existing eyeglasses holders are designed to hold side-by-side eyeglasses on a plurality of rails or on a plurality of notches. Such devices are designed to hold eyeglasses in only one plane and are not well adapted for shop window display. In other words, these holders are not well adapted to set the products in a fashionable way, like in an unconventional orientation. These holders also interfere with the aesthetic aspect of the eyeglass since their presence is predominant. Examples of such holders are disclosed in U.S. Pat. Nos. 4,558,788 and 4,890,745.

To set a shop window display, the products must be disposed in an environment and in a way that will attract the consumer's attention. This usually requires to show the products individually and with different angles. The present invention is very suitable to achieve this requirement. It also permits to hold the eyeglass with minimum disturbance of its aesthetic aspect.

SUMMARY OF THE INVENTION

The object of the present invention is to provide a holder for displaying one or more products in a very attractive manner and in any desired orientation.

More specifically, this invention provides an display apparatus comprising:

(a) a holding means;

(b) at least one main stem having two opposite ends, one of the opposite ends being a free end;

(c) a first attachment means to the at least main stem to the holding means; and (d) a tip element comprising:

a tip member fixed to the free end of the at least one main stem by a second attachment means, another stem projecting from the tip member, the other stem having a free end and a second end attached to said tip member by a third attachment means, and a means to attach a product to be displayed fixed to the free end of the other stem by a fourth attachment means.

In accordance with a preferred embodiment, the main stem is L-shaped, adjacent the end opposite to the free end of the main stem, and has a circular cross-section.

The first attachment means preferably comprises a hole made in the holding means, in which the end opposite to the free end of the main stem is pivotally engaged.

The second attachment means preferably comprises a hole made in the tip member, in which the free end of the main stem is pivotally engaged.

According to another preferred embodiment, the other stem is L-shaped and said third attachment means comprises a hole, made in the tip member, in which the second end of the other stem is pivotally engaged.

The means used to attach a product is preferably a vise pivotally attached to the free end of the other stem by the fourth attachment means. The fourth attachment means comprises a hole made in the means to attach a product, in which the free end of the other stem is pivotally engaged. The vise comprises two jaws between which the product is held. The vise preferably comprises two screws to move the jaws toward and away from each other. Each of the two screws has a large, finger-operable head.

According to a further preferred embodiment, the display apparatus further comprises at least one sliding element movable along and rotatable about the main stem between the opposite ends thereof, the sliding element comprising:

a sliding member slidably mounted onto the main stem, the sliding member being lockable in any desired position along the main stem, an additional L-shaped stem projecting from the sliding member, the additional L-shaped stem having a first arm fixed to said sliding member by a fifth attachment means and a second arm projecting from the sliding member. The additional L-shaped stem also has a second arm projecting from the sliding member, the fifth attachment means preferably comprising a hole made in the sliding member, in which the first arm is pivotally engaged; and another means to attach a product to be displayed fixed to the second arm by a sixth attachment means.

The sliding member is preferably constructed as a slidable vise and is lockable by a screw having a large, finger-operable head. The other means used to attach a product to the second arm is preferably another vise pivotally attached to the second arm by the sixth attachment means. The sixth attachment means preferably comprises a hole made in the other vise, in which the second arm is pivotally engaged. The other vise comprises two jaws between which an additional product is held. Preferably, the other vise comprises two screws to move the jaws toward and away from each other the jaws. Each of the two screws has a large, finger-operated head.

According to still a preferred embodiment, the first, second, third and fourth attachment means comprise at least one friction screw located in a threaded hole perpendicular to and intersecting one of the stems. Each of the screws has a friction tip, preferably made of brass, in contact with one of the stems and generating an adjustable friction force.

The fifth and the sixth attachment means may also comprise at least one friction screw located in a threaded hole perpendicular to and intersecting the additional L-shaped stem. Each of the friction screws has a friction tip in contact with the additional L-shaped stem and generating an adjustable friction force.

The holding means may comprise a base, having preferably a rectangular shape, made of, or filled up with, a heavy material. Preferably, the means to attach a product to be displayed is made of a material that is not susceptible to scratch the product, such as plastic.

A non restrictive description of a preferred embodiment of the invention will now be given with reference to the appended drawings.

DESCRIPTION OF PREFERRED EMBODIMENT

Figure 1:
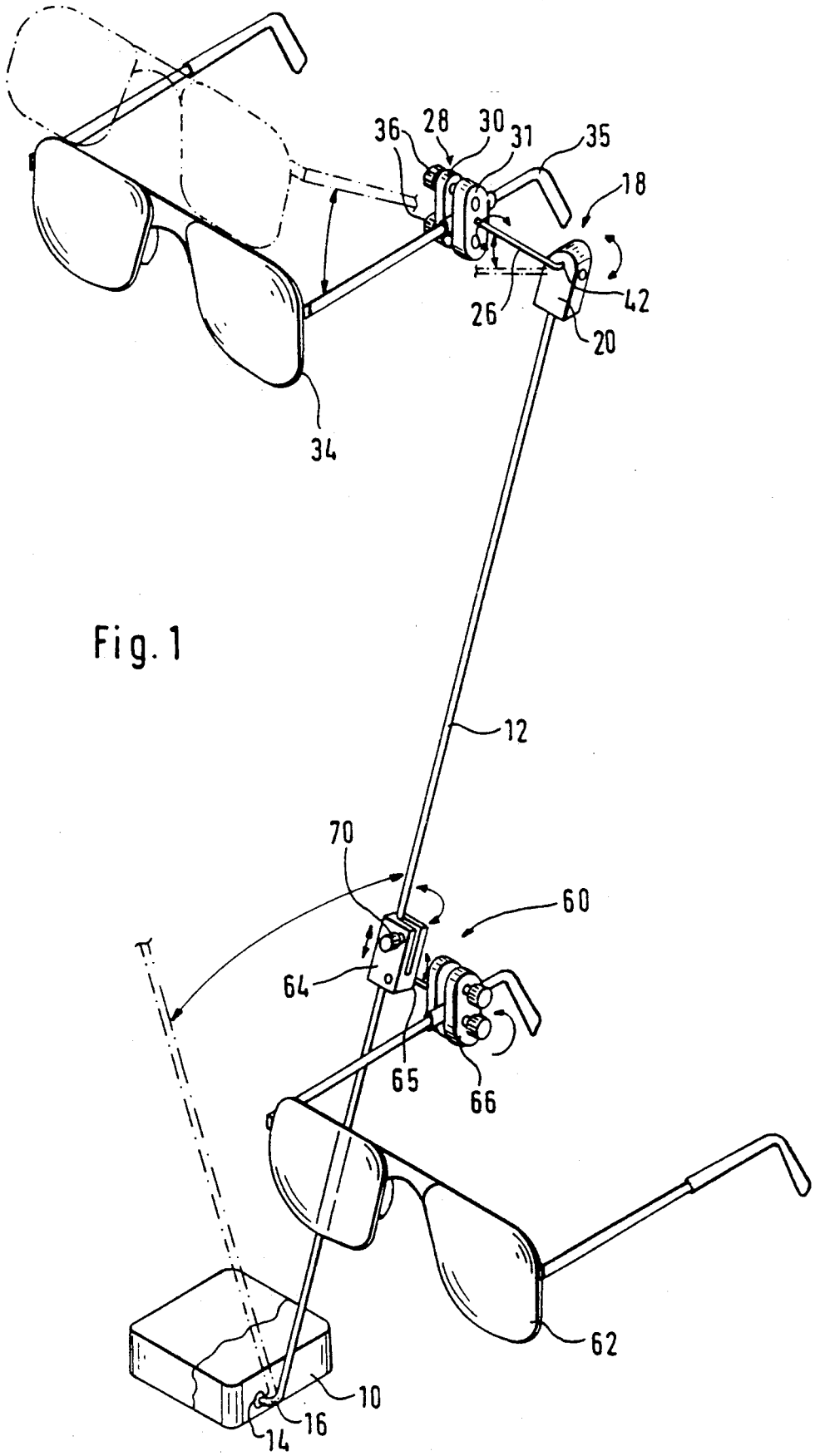
FIG. 1 is a perspective view of a display apparatus according to the invention.

The apparatus according to the invention as shown in FIG. 1 comprises holding means consisting of a box-shaped base 10 to which is fixed a main stem 12 that is made up of a hard steel and has a circular cross section. The base 10 is used when the apparatus is to be placed on a surface such as a table. The purpose of the base 10 is to support the main stem 12 and the other components of the apparatus. More than one main stems can be supported by the base 10. The base 10 is made of, or filled up with a heavy material such as brass, to provide more stability to eccentric loads. The brass is advantageous because it can be easily machined. The box-shaped base 10 may also have a rectangular shape but any other shape can be convenient.

It is also possible to have a base having a pin underneath the base 10 that can be inserted in a hole located in a board to prevent the holder from toppling. The base 10 can then be lighter and stand very eccentric loads, like when two or more main stems are used.

Figure 2:
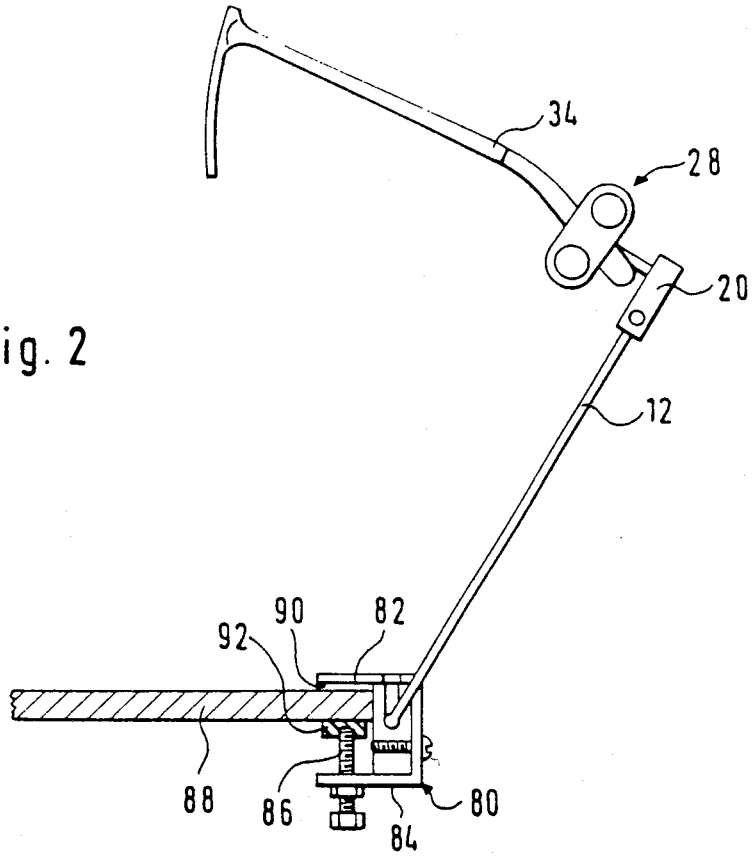
FIG. 2 is a side elevational view of the apparatus shown in FIG. 1, but fixed to an edge of a table.

The holding means may consist of a stirrup piece 80 as shown in FIG. 2, that is screwable onto an horizontal or vertical supporting member such as a counter, a ceiling tile, a slot wall or an edge of other objects.

The holding means may further consist of a suction cup (not shown) that is attachable on a flat and smooth surface such as, for example, a window.

The holding means may also further consist of a pad (not shown) that can be glued to fix the apparatus to a surface.

Figure 9:
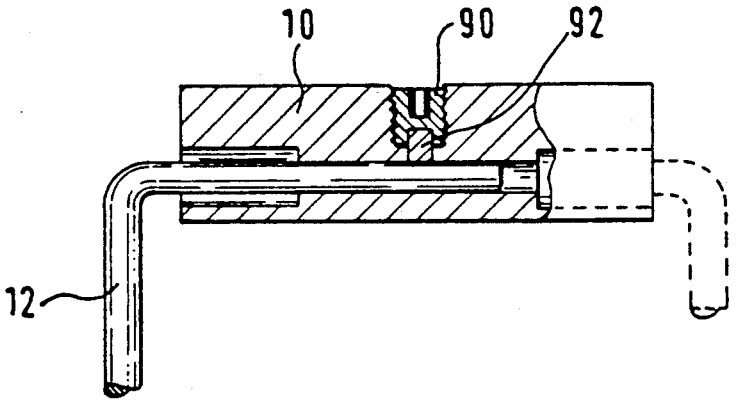
FIG. 9 is a side elevational in partial cross section view of the base of the apparatus of FIG. 1.
Figure 10:
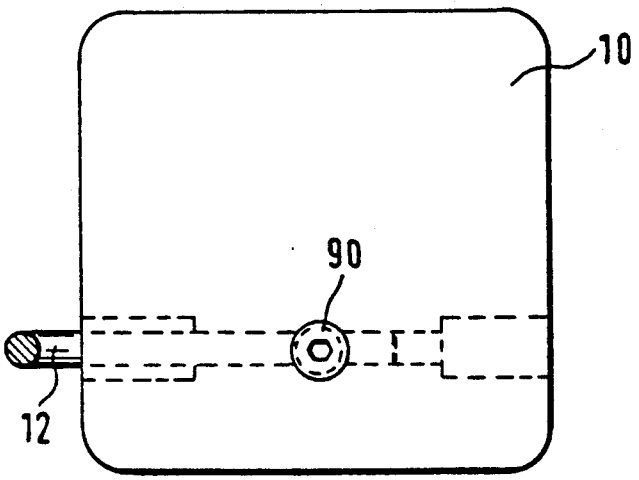
FIG. 10 is a bottom elevational view of the base shown in FIG. 9.

The main stem 12 is pivotally engaged to the base 10 by means of a hole 14 in which a L-shaped portion 16 of the main stem 12 is entered. A screw 90 (FIG. 9) is used to apply a friction on the main stem 12 so that the main stem 12 cannot turn too easily or be easily removed from the base 10. The desired friction is set by the user by screwing or unscrewing the screw 90 which is located in a threaded hole perpendicular to and intersecting the hole in which the main stem 12 is inserted to be held by the base 10. The friction generated by the contact of the screw on the surface of the main stem 12 is such that the swivel cannot turn under the weight of the main stem 12 or the weight of what it supports while giving the user the possibility to rotate the main stem 12 without having to use a tool or having to unscrew the screw 90. A brass tip 92 is used as a friction tip to generate friction without damaging the surface of the main stem 12 since the brass is softer than the steel.

A fired paint may be applied on the surface of the main stem 12. The L-shaped portion is angled at about 90°. The diameter of the hole 14 is slightly higher than the diameter of the main stem 12 so the L-shaped portion 16 can easily rotate in the hole 14.

Figure 3:
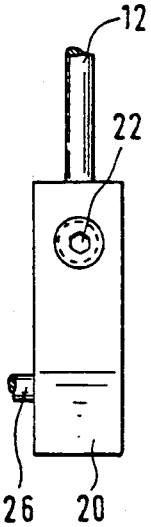
FIG. 3 is a front elevational view of the tip member of the apparatus of FIG. 1.

According to the invention, as shown in FIG. 1, the apparatus also comprises a tip element 18 fixed to the free end of the main stem 12. The tip element 18 comprises a tip member 20 which is pivotally attach to the free end of the main stem 12. A screw 22 (FIG. 4) is used to apply a friction on the main stem 12 so that the tip member 20 cannot turn too easily or be easily removed from the main stem 12. The desired friction is set by the user by screwing or unscrewing the screw 22 (FIG. 3) which is located in a threaded hole perpendicular to and intersecting the hole in which the main stem 12 is inserted. The friction generated by the contact of the screw on the surface of the main stem 12 is such that the swivels cannot turn under the weight of what they are supporting while also giving the user the possibility to rotate the stems without having to use a tool or having to unscrew the screws. A brass tip 24 may be used as a friction tip to generate friction without damaging the surface of the main stem 12.

The apparatus also comprises another stem 26 fixed to the tip member 20. Means to attach a product such as an eyeglass or a jewel are fixed to the free end of the other stem 26. These means are a vise 28 comprising two jaws 30 and 31 that can be adjusted to squeeze a part of the product such as the temple end of the eyeglass 34. The two jaws 30 and 31 are brought closer to each other by means of two screws 36 so the vise can generate the proper amount of friction to hold the product. The vise 28 is preferably made of a plastic material that is not susceptible to scratch the product held.

The jaw 30 has two holes 32 in which the screws 36 are inserted and the jaw 31 has two threaded holes in which the end of the screws 36 are inserted. The screws 36 mesh with the threaded brass inserts 41. The inserts 41 are used to prevent the wear of the jaw 31 that is likely to happen if the threaded hole was done directly in it since the jaw 31 is preferably made of plastic. When the screws 36 are unscrewed, the two jaws 30 and 31 are moved away from each other by means of helicoidal springs 38 concentric to each screw 36. The springs 38 help keeping the two jaws away from each other when substituting a product for another. Two recesses 37 concentric to the springs 38 allow the springs 38 to not interfere when the two jaws 30 and 31 are very close to each other. Each screw 36 has a large, finger-operated head 40 so that it be turned without need of a tool such as a screwdriver or a hexagonal key.

Figure 4:
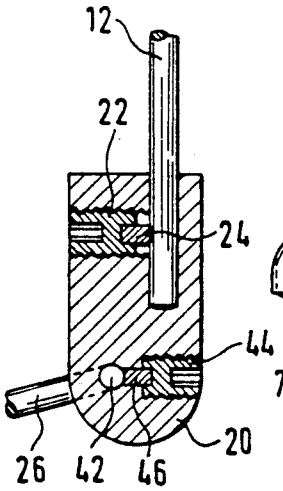
FIG. 4 is a side elevational cross section view of the tip member shown in FIG. 3.
Figure 5:
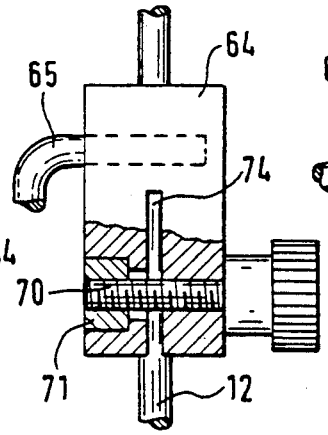
FIG. 5 is a front elevational in partial cross section view of the sliding member of the apparatus of FIG. 1.
Figure 6:
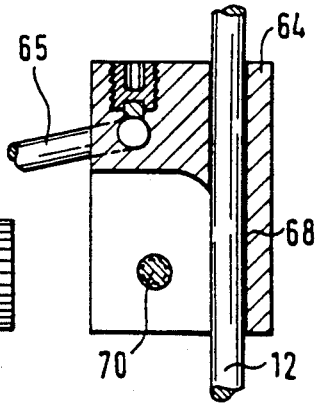
FIG. 6 is a side elevational cross section view of a sliding member shown in FIG. 5.
Figure 7:
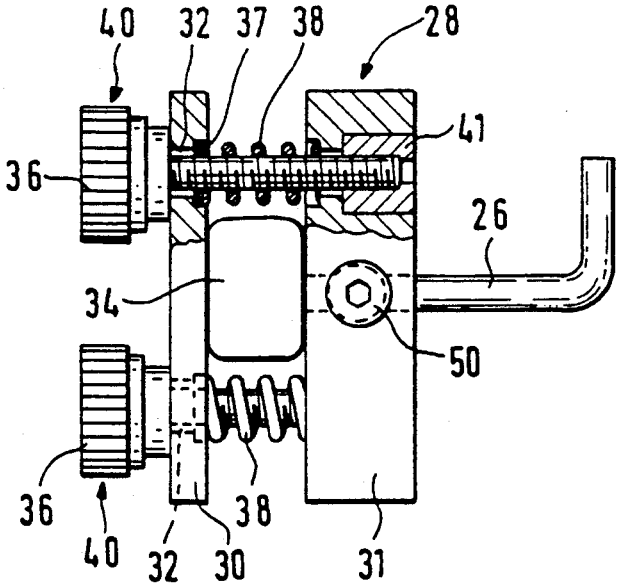
FIG. 7 is a side elevational view in partial cross section of the attaching vise of the tip member of the apparatus of FIG. 1.
Figure 8:
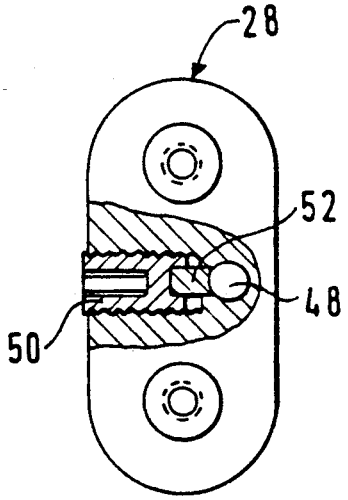
FIG. 8 is a bottom plan view in partial cross section of the vise shown in FIG. 7.

As shown in FIGS. 1 and 4, the other stem 26 is preferably L-shaped and has an end pivotally fix to the tip member 20 by means of a hole 42 in which the L-shaped end of the other stem 26 is inserted. A screw 44, with a brass tip 46, is used to apply a friction that holds the other stem 26 in any desired position and prevents it from turning by itself under its weight or the weight of the product. The vise 28 (FIGS. 7 and 8) is pivotally fixed to the other stem 26 by insertion of the free end of the other stem 26 into a hole 48. A screw 50, with a brass tip 52, is used to apply a friction that holds the vise 28 in the desired position and prevents it from turning by itself under its weight or the weight of the product. The screw 50 is located in a threaded hole perpendicular to and intersecting the hole in which the other stem 26 is inserted.

The apparatus may further comprise one or more sliding elements 60 to hold other products Each sliding element 60 is mounted onto the main stem 12 and is movable along and rotatable about it between its base 10 and the tip member 20. It comprises a sliding member 64, such as a vise, mounted onto the main stem 12. An L-shaped stem 65 having one arm inserted in a hole in the sliding member 64. The L-shaped stem 65 is pivotally mounted in the hole. The sliding member 60 also comprises a means to attach a product such as the vise 66 which is identical to the vise 28. The sliding member 64 is preferably operated by a screw 70 have a large, finger-operated head that meshes with a threaded brass insert 71. The screw 70 brings together the two parts of the sliding member 64 that are separated by the slot 74.

When displaying an eyeglass, the eyeglass is preferably displayed in an open position To achieve this, the screws attaching the temples to the eyeglass frame are tightened. The earpiece of one of the temples is then inserted between the jaws 30 and 31, which are then tightened to hold the eyeglass.

The invention, as shown in FIG. 1, allows the product to be displayed in a plurality of orientations. More specifically, the product on the tip element can be oriented in about 4 degrees of freedom represented by arrows on FIG. 1: the main stem 12 can rotate in one plane, the tip member can rotate about the main stem 12, the other stem 26 can rotate in one plane and the vise 28 can rotate about the free end of the other stem 26 The product held with the sliding element has 5 degrees of freedom: the main stem 12 can rotate in one plane, the sliding member 64 can rotate about and slide along the main stem 12, the other stem 65 can rotate in one plane and the vise 66 can rotate about the free end of the other stem 65.

The embodiments of the invention in which on exclusive property or privilege is claimed are defined as follows:

1. A display apparatus comprising:

(a) a holding means;

(b) at least one main stem having two opposite ends, one of said opposite ends being a free end;

(c) a first attachment means to fix said at least one main stem to said holding means; and (d) a tip element comprising:

a tip member fixed to said free end of said at least one main stem by a second attachment means, another stem projecting from said tip member, said other stem having a free end and a second end fixed to said tip member by a third attachment means, and a means to attach a product to be displayed fixed to said free end of said other stem by a fourth attachment means;

whereby said at least one main stem is L-shaped adjacent said end opposite to said free end of said at least one main stem and has a circular cross-section.

2. The display apparatus of claim 1, wherein said first attachment means comprises a hole made in said holding means, in which said end opposite to said free end of said at least one main stem is pivotally engaged.

3. The display apparatus of claim 1, wherein said second attachment means comprise a hole made in said tip member, in which said free end of said at least one main stem is pivotally engaged.

4. The display apparatus of claim 2, wherein said other stem is L-shaped and said third attachment means comprises a hole made in said tip member, in which said second end of said other stem is pivotally engaged, said means to attach a product being a vise pivotally attached to said free end of said other stem by a fourth attachment means, comprising a hole made in the vise, in which said free end of said other stem is pivotally engaged, said vise comprising two jaws between which said product is held.

5. The display apparatus of claim 4, wherein said vise also comprises two screws to move said jaws toward and away from each other, each of said two screws having a large, finger-operable head.

6. The display apparatus of claim 2, further comprising at least one sliding element movable along and rotatable about said at least one main stem between said opposite ends thereof, said at least one sliding element comprising:

a sliding member slidably mounted onto said main stem, said sliding member being lockable in any desired position along said main stem, an additional L-shaped stem projecting from said sliding member, said additional L-shaped stem having a first arm fixed to said sliding member by a fifth attachment means and a second arm projecting from said sliding member, said fifth attachment means comprising a hole made in said sliding member, in which said first arm is pivotally engaged, and another means to attach a product to be displayed fixed to said second arm by a sixth attachment means.

7. The display apparatus of claim 6, wherein said sliding member is constructed as a sliding vise and is lockable by a screw having a large, finger-operable head.

8. The display apparatus of claim 7, wherein said other means to attach a product to said second arm is another vise pivotally attached to said other arm of said sixth attachment means and comprises two jaws between which an additional product is held, said sixth attachment means comprising a hole made in said other vise, in which said second arm is pivotally engaged.

9. The display apparatus of claim 8, wherein said other vise comprises two screws to move said jaws toward and away from each other, each of said two screws having a large, finger-operated head.

10. The display apparatus of claim 3, wherein said first, second, third and fourth attachment means comprise at least one friction screw located in a threaded hole perpendicular to and intersecting one of said stems, each of said screws having a friction tip in contact with said one of said stems and generating an adjustable friction force.

11. The display apparatus of claim 6, wherein said fifth and said sixth attachment means comprise at least one friction screw located in a threaded hole perpendicular to and intersecting said additional L-shaped stem, each of said friction screws having a friction tip in contact with said additional L-shaped stem.

12. The display apparatus of claim 10, wherein said friction tips are made of brass.

13. The display apparatus of claim 11, wherein said friction tips are made of brass.

14. The display apparatus of claim 2, wherein said holding means is a base made of, or filled up with, a heavy material.

15. The display apparatus of claim 2, wherein said holding means comprise a stirrup piece screwable onto a supporting member.

16. The display apparatus of claim 2, wherein said means to attach a product to be displayed is made of a material that is not susceptible to scratch said product.

17. The display apparatus of claim 16, wherein said material is plastic.

18. A display apparatus comprising:

(a) a holding means;

(b) a main stem having a circular cross section and two opposite ends, one of said opposite ends being a free end, said main stem being L-shaped adjacent to said end opposite to said free end of said main stem;

(c) a first attachment means to fix said main stem to said holding means, said first attachment means comprising a hole made in said holding means, in which said L-shaped end is pivotally engaged;

(d) a tip element comprising:

a tip member fixed to said free end of said main stem by a second attachment means, said second attachment means comprising a hole made in said tip member, in which said free end of said main stem is pivotally engaged, another stem L-shaped and projecting from and pivotally fix to said tip member by a third attachment means, said other stem having a free end and a second end fixed to said tip member by said third attachment means said third attachment means comprising a hole made in said tip member, in which said second end of said other stem is pivotally engaged, and means to attach a first product to be displayed to said free end of said other stem, said means to attach a first product comprising a first vise pivotally attached to said free end of said other stem by a fourth attachment means comprising a hole made in said vise, in which said free end of said other stem is pivotally engaged, said vise comprising two jaws between which said first product is held and two screws, each of said two screws having a large, finger-operable head to move said jaws toward and away from each other; and (e) at least one sliding element movable along and rotatable about said main stem between said opposite ends thereof, said at least one sliding element comprising:

a sliding member slidably mounted onto said main stem, said sliding member being lockable in any desired position along said main stem, an additional L-shaped stem fixed to said sliding member by a fifth attachment means, said additional L-shaped stem having a first arm pivotally engaged into a hole in said sliding member and a second arm projecting from said sliding member, said fifth attachment means comprising a hole made in said sliding member, in which said first arm is pivotally engaged, and another means to attach a second product to be displayed to said other arm, said other means to attach a second product to said other arm being a second vise pivotally fixed to said other arm of said sliding member by a sixth attachment means and comprising two jaws between which said second product is held, said sixth attachment means comprising a hole made in said second vise, in which said second arm is pivotally engaged; wherein said first, second, third, fourth, fifth and sixth attachment means comprise a friction screw located in a threaded hole perpendicular to and intersecting one of said stems, said screw having a friction tip made of brass, in contact with said stems and generating an adjustable friction force such as to be able to rotate said stems without a tool.

19. The display apparatus of claim 18, wherein at least one of said first and second products is an eyeglass.

* * * * *